US008313288B2

(12) United States Patent
Schlichting et al.

(10) Patent No.: US 8,313,288 B2
(45) Date of Patent: Nov. 20, 2012

(54) MECHANICAL ATTACHMENT OF CERAMIC OR METALLIC FOAM MATERIALS

(75) Inventors: Kevin W. Schlichting, Storrs, CT (US); Melvin Freling, West Hartford, CT (US); James A. Dierberger, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 1398 days.

(21) Appl. No.: 11/850,690

(22) Filed: Sep. 6, 2007

(65) Prior Publication Data

US 2010/0266391 A1 Oct. 21, 2010

(51) Int. Cl.
*F01D 11/12* (2006.01)

(52) U.S. Cl. ..... 415/173.4; 415/200

(58) Field of Classification Search ..... 415/173.4, 415/174.4

See application file for complete search history.

(56) References Cited

U.S. PATENT DOCUMENTS 3,825,364 A * 7/1974 Halila et al. ..... 415/116
4,273,824 A 6/1981 McComas
4,363,208 A 12/1982 Hoffman
4,460,311 A * 7/1984 Trappmann et al. ..... 415/116
4,704,332 A 11/1987 Brennan
4,728,257 A * 3/1988 Handschuh ..... 415/136
4,923,747 A * 5/1990 McCullough et al. ..... 428/312.6
5,064,727 A 11/1991 Naik
5,331,816 A 7/1994 Able
5,592,814 A 1/1997 Palusis
6,102,656 A 8/2000 Nissley
6,177,200 B1 1/2001 Maloney
6,284,323 B1 9/2001 Maloney
6,358,002 B1 3/2002 Good
6,428,280 B1 8/2002 Austin
6,443,700 B1 9/2002 Grylls
6,648,596 B1 11/2003 Grylls
6,652,227 B2 * 11/2003 Fried ..... 415/173.4
6,835,465 B2 12/2004 Allen
6,920,762 B2 7/2005 Wells
6,924,040 B2 8/2005 Maloney
7,273,351 B2 * 9/2007 Kopmels ..... 416/97 R
7,775,766 B2 * 8/2010 Meier et al. ..... 415/173.4
2003/0123953 A1 * 7/2003 Razzell ..... 411/419
2005/0111966 A1 * 5/2005 Metheny ..... 415/116
2005/0249602 A1 11/2005 Freling
2006/0242965 A1 11/2006 Shi

FOREIGN PATENT DOCUMENTS

EP 1719949 11/2006
EP 1741981 1/2007

* cited by examiner

*Primary Examiner* — Richard Edgar
(74) *Attorney, Agent, or Firm* — Carlson, Gaskey & Olds, P.C.

(57) ABSTRACT

A thermal barrier includes a thermal barrier member having at least one material selected from a metal foam or a ceramic foam. The thermal barrier member includes an attachment section for securing the thermal barrier member with a corresponding attachment section of a support.

18 Claims, 3 Drawing Sheets

MECHANICAL ATTACHMENT OF CERAMIC OR METALLIC FOAM MATERIALS

BACKGROUND OF THE INVENTION

This invention relates to thermal barriers and, more particularly, to a ceramic or metal foam thermal barrier that may be mechanically attached to a support.

Components that are exposed to high temperatures, such as gas turbine engine components, typically include a protective coating system having one or more coating layers. For example, turbine blades, turbine vanes, combustor linings, and blade outer air seals may include a coating system or liner to protect from erosion, oxidation, corrosion or the like to thereby enhance durability or maintain efficient operation of the engine.

Typical coating systems include a ceramic coating that is applied onto a substrate. Additional intermediate layers, such as bond coats, may be used between the ceramic coating and the substrate. Although effective, under certain thermal conditions, ceramic coatings may crack, erode, oxidize, or otherwise corrode to cause spalling.

Accordingly, there is a need for other types of structures that have enhanced thermal resistance and a method for securing the structures to a component or support.

SUMMARY OF THE INVENTION

An example thermal barrier includes a thermal barrier member having at least one material selected from a metal foam or a ceramic foam. The thermal barrier member includes an attachment section for securing the thermal barrier member with a corresponding attachment section of a support.

In one example, the attachment section of the thermal barrier member is a slot for removably securing the thermal barrier member with the corresponding attachment section of the support. In some examples, the thermal barrier member includes a porosity gradient between sides of the thermal barrier member.

In a disclosed example, the thermal barrier member is part of a blade outer air seal within a turbine engine, where the turbine engine includes a combustion section and a turbine section downstream of the combustion section. The blade outer air seal is located radially outwards of a turbine blade of the turbine section.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
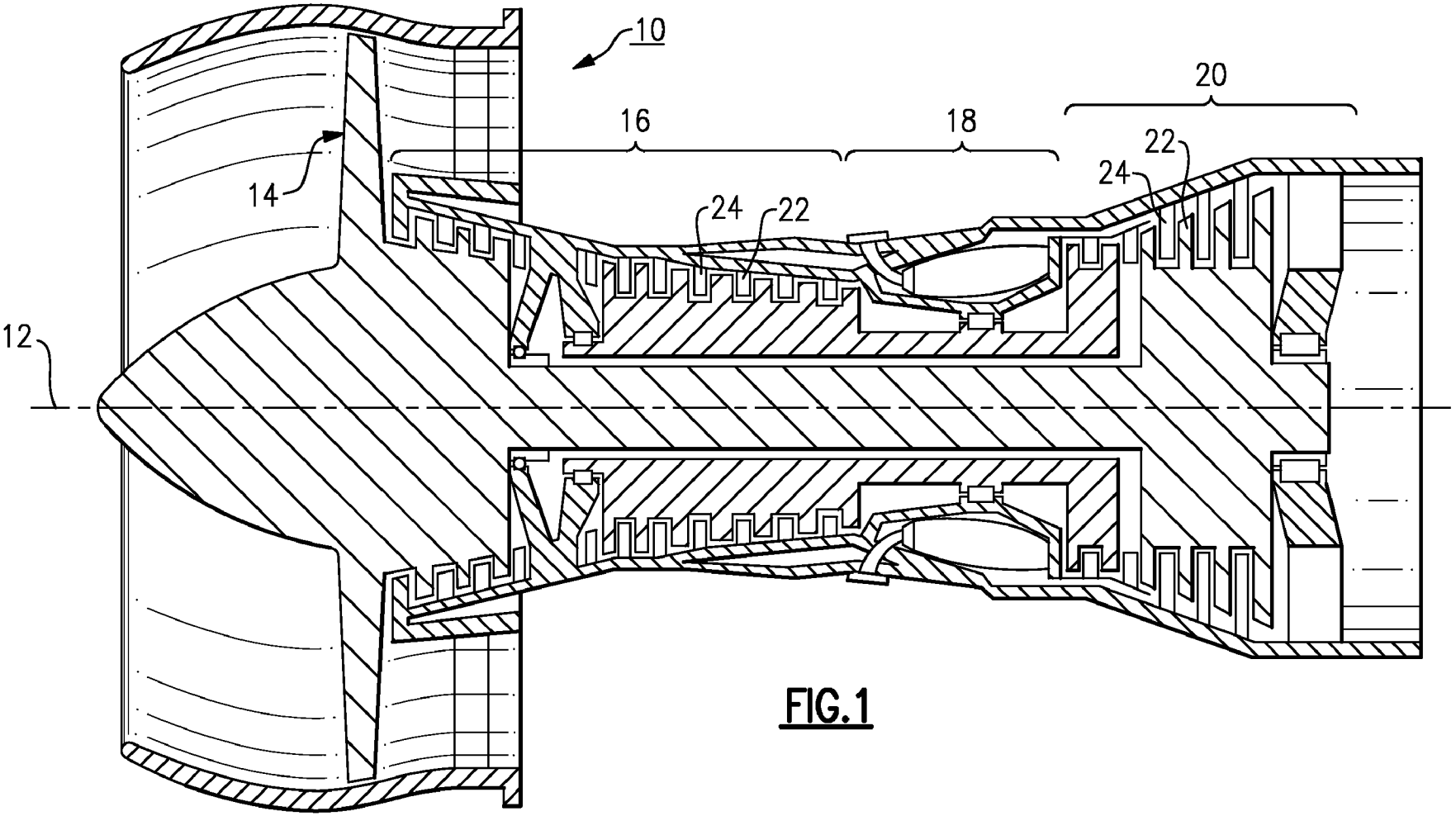
FIG. 1 illustrates an example gas turbine engine.

FIG. 1 illustrates selected portions of an example gas turbine engine 10, such as a gas turbine engine 10 used for propulsion. In this example, the turbine engine 10 is circumferentially disposed about an engine centerline 12 and includes a fan 14, a compressor section 16, a combustion section 18, and a turbine section 20. The combustion section 18 and the turbine section 20 include corresponding blades 22 and vanes 24. In other examples, the engine 10 may include additional engine sections or fewer engine sections than are shown in the illustrated example, depending on the type of engine and its intended use.

As is known, air compressed in the compressor section 16 is mixed with fuel and burned in the combustion section 18 to produce combustion gases that are expanded in the turbine section 20. FIG. 1 is a somewhat schematic presentation for illustrative purposes only and is not a limitation on the disclosed examples. Additionally, there are various types of gas turbine engines, many of which could benefit from the examples disclosed herein and are not limited to the designs shown.

Figure 2:
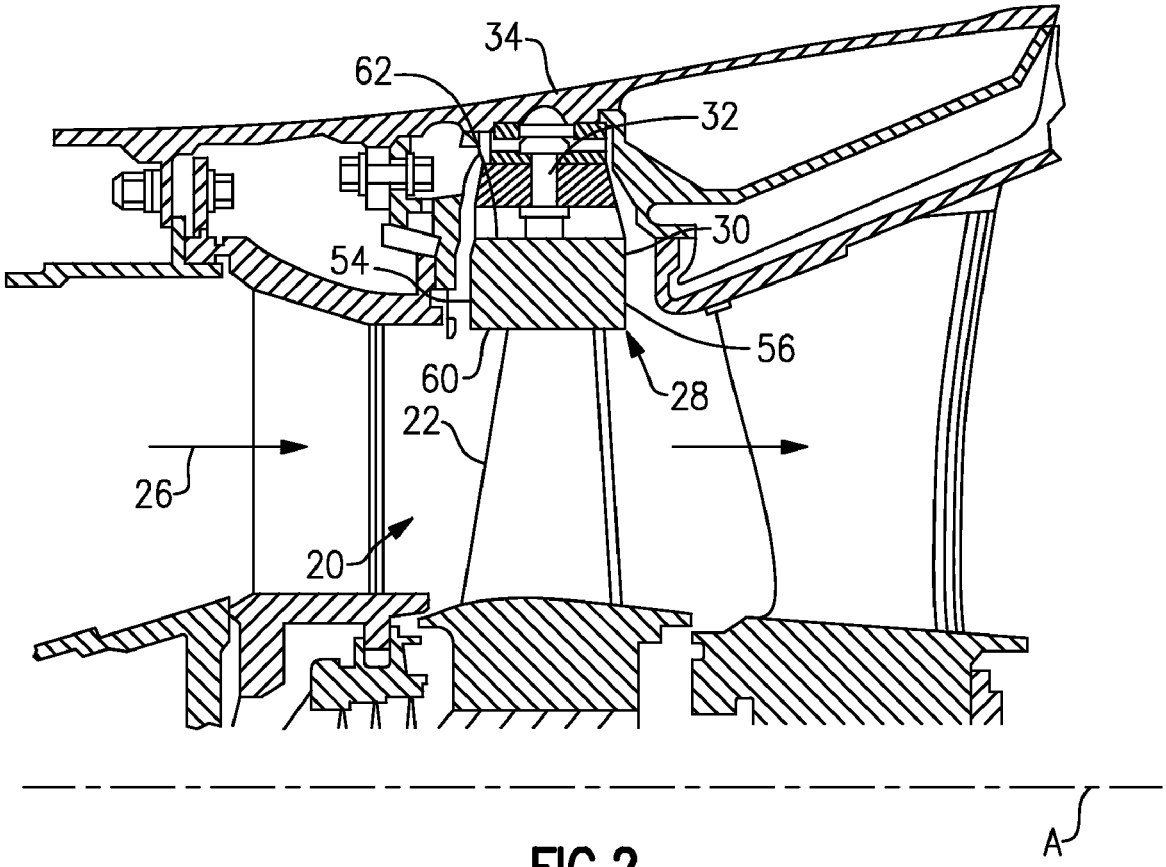
FIG. 2 illustrates a turbine section of the gas turbine engine.

FIG. 2 illustrates selected portions of the turbine section 20. The turbine blade 22 receives a hot gas flow 26 from the combustion section 18 (FIG. 1). The turbine section 20 includes a blade outer air seal system 28 having a seal member 30 that functions as an outer wall for the hot gas flow 26 through the turbine section 20. The seal member 30 is secured to a support 32, which is in turn secured to a case 34 that generally surrounds the turbine section 20. For example, a plurality of the seal members 30 are circumferentially located about the turbine section 20 in a ring assembly. The seal member 30 is shown somewhat schematically in FIG. 2 and can take a variety of different forms, as shown in the non-limiting examples that follow.

Figure 3:
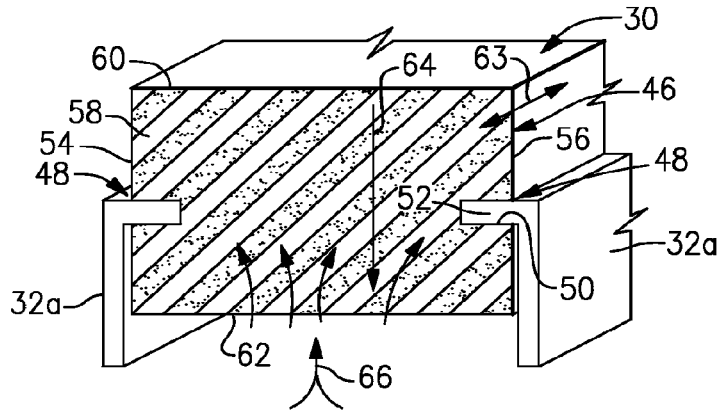
FIG. 3 illustrates a portion of a seal member within the turbine section.

FIG. 3 illustrates an example portion of the seal member 30. Although the seal member 30 is shown in the illustrated example, it is to be understood that the disclosed examples may also be applied to other types of engine or non-engine components, such as but not limited to combustor liners. In this example, the seal member 30 includes a thermal barrier member 46 that is mechanically attached to supports 32*a*. The supports 32*a* are secured to the case 34, as shown for the supports 32 of FIG. 2.

In the disclosed example, the thermal barrier member 46 includes attachment sections 48 for mechanically interlocking with the supports 32*a*. The attachment sections 48 each include a slot 50 that receives corresponding tabs 52 of the supports 32*a*.

The thermal barrier member 46 includes a leading edge 54, a trailing edge 56, circumferential sides 58, a radially inner side 60, and a radially outer side 62 relative to the engine centerline 12. In the disclosed example, the slots 50 extend through the respective leading edge 54 and trailing edge 56. The location of the slots 50 at the leading edge 54 and trailing edge 56 provides the benefit of permitting the thermal barrier member 46 to directly seal against a circumferentially neighboring seal member 30 in the ring assembly. The location also leaves the radially outer side 62 unobstructed to provide an open area for cooling fluid flow, if cooling is used.

In one example, a plurality of the thermal barrier members 46 are assembled circumferentially side by side around a circumference of the engine 10 into the ring assembly. For example, each of the thermal barrier members 46 may be removably slid onto the supports 32*a*, as indicated by arrow 63. Alternatively, the slots 50 may extend through the circumferential sides 58 such that the thermal barrier member 46 axially slides onto the supports 32*a*.

In the disclosed example, the thermal barrier member 46 includes a foam structure. For example, the foam structure may include a ceramic foam or a metal foam that is formed into a tile. In one example, the ceramic foam includes a ceramic material selected from at least one of zirconia, yttria-stabilized zirconia, silicon carbide, alumina, titania, or mullite. In a further example, the yttria-stabilized zirconia includes about 7 wt % of the yttria and a balance of zirconia or about 20 wt % of the yttria and a balance of the zirconia.

If the foam structure is metal foam, the metal foam may include at least one metal selected from a nickel-based alloy, a cobalt-based alloy, a molybdenum-based alloy, or a niobium-based alloy. Given this description, one of ordinary skill in the art will be able to recognize other foam structures that are suitable to fit their particular needs.

The foam structure of the thermal barrier member 46 may be fabricated using any suitable method. For example, a slurry of metal or ceramic particles may be infiltrated into a porous polymer foam and heated to remove the polymer and sinter the metal or ceramic particles together to form a foam structure. Alternatively, a foaming agent may be used in combination with a metal or ceramic slurry to form pores upon heating the slurry to sinter the metal or ceramic particles together.

In another example, polymer particles may be mixed with a slurry having metal or ceramic particles and formed into a green body. The green body may then be heated to thermally remove the polymer particles and form pores in the green body. The green body is then heated to sinter the metal or ceramic particles together. Given this description, one of ordinary skill in the art will recognize other suitable foam structure fabrication methods to meet their particular needs.

Optionally, the thermal barrier member 46 may include a porosity gradient 64 that extends between the radially outer side 62 and the radially inner side 60. For example, the porosity gradient 64 may include a larger average pore size near the radially inner side 60 and a relatively smaller average pore size near the radially outer side 62. The pore gradient 64 may provide the benefit of enhanced abradability at the radially inner side 60 for contact with tips of the turbine blades 22 and enhanced structural strength through the body of the thermal barrier member 46 for resisting stresses between the support 32*a* and the thermal barrier member 46.

Optionally, a cooling source 66 may be used to provide cooling air to the thermal barrier member 46. For example, the cooling source 66 is an impingement cooling arrangement provided by a bleed flow from a relatively cool air stream through the gas turbine engine 10. The cooling source 66 provides cooling air on the radially outer side 62. The cooling air infiltrates the pores of the foam structure of the thermal barrier member 46. The open cell pores relatively uniformly distribute the cooling air through the thermal barrier member 46 to provide uniform cooling. Using the pores to evenly distribute the cooling air may permit machined or formed cooling passages to be eliminated in at least some examples.

Figure 4:
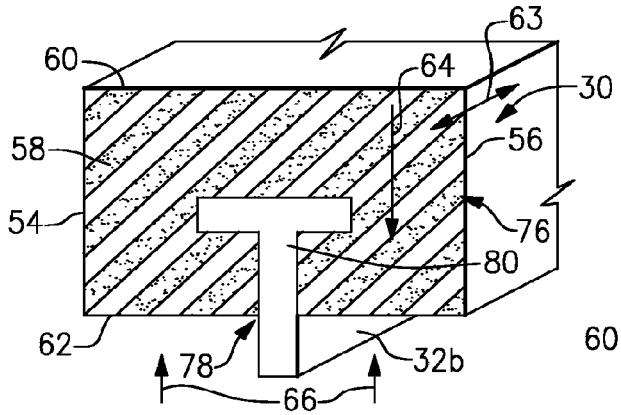
FIG. 4 illustrates another embodiment of a seal member.

FIG. 4 illustrates another embodiment of the seal member 30. In this example, components that are similar to components of the previous example are numbered alike. The seal member 30 of this example includes a thermal barrier member 76 having an attachment section 78 for mechanically interlocking with a corresponding attachment section of a support 32*b*. The support 32*b* is secured to the case 34, as shown for the support 32 of FIG. 2.

The thermal barrier member 76 is similar to the thermal barrier member 46 of the previous example, except that the attachment section 78 opens to the radially outer side 62 and has a different shape. The attachment section 78 includes a T-shaped slot 80 formed in the thermal barrier member 76. The T-shaped slot 80 corresponds to a T-shape of the support 32*b* such that the slot 80 and the support 32*b* mechanically interlock to secure the thermal barrier member 76 to the support 32*b*. In one example, the thermal barrier member 76 can be removably assembly with the support 32*b*.

The slot 80 of the thermal barrier member 76 may be formed in any suitable manner as discussed above and with any desired orientation relative to the circumferential sides 58, leading edge 54, and trailing edge 56. For example, the slot 80 can be machined into the thermal barrier member 76, such as by using a cutting tool or electro-discharge machining. Alternatively, the slot 80 can be formed in the thermal barrier member 76 during fabrication of the thermal barrier member 76, such as by forming the slurries described above into a green body having a desired shape.

Figure 5:
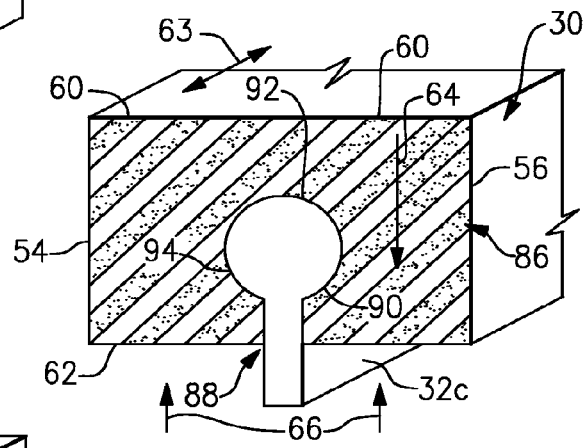
FIG. 5 illustrates another embodiment of a seal member.

FIG. 5 illustrates another embodiment of the seal member 30. In this example, components that are similar to components of the previous example are numbered alike. The seal member 30 includes a thermal barrier member 86 having an attachment section 88. The thermal barrier member 86 in this example is similar to the thermal barrier members 76 and 48 of the previous examples except that the attachment section 88 and corresponding support 32*c* have a different shape. The attachment section 88 includes a slot 90 having a curved wall 92 for receiving a bulb section 94 of the support 32*c*. The slot 90 may be formed in any suitable manner as discussed above and with any desired orientation relative to the circumferential sides 58, leading edge 54, and trailing edge 56. The bulb section 84 may be spherical or elongated in a cylindrical shape. The slot 90 and the bulb section 94 of the support 32*c* mechanically interlock to secure the thermal barrier member 86 to the support 32*c*. The support 32*c* is secured to the case 34, as shown for the support 32 of FIG. 2.

In this example, the curved walls 92 of the slot 90 provide the benefit of providing relatively low stress interfaces between the thermal barrier member 86 and the support 32*c* that avoids stress concentrators that may be associated with relatively sharp angle interfaces.

Figure 6:
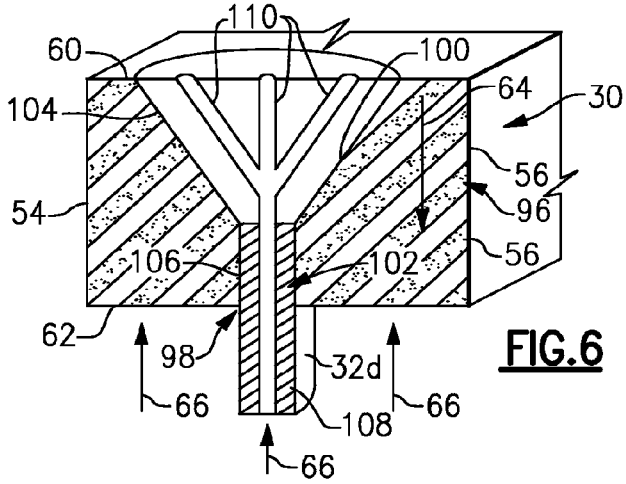
FIG. 6 illustrates another embodiment of a seal member.

FIG. 6 illustrates another embodiment of the seal member 30. In this example, components that are similar to components of the previous example are numbered alike. The seal member 30 includes a thermal barrier member 96 having an attachment section 98 for mechanically interlocking with a corresponding attachment section of a support 32*d*. The support 32*d* is secured to the case 34, as shown for the support 32 of FIG. 2.

In this example, the thermal barrier member 96 is similar to the thermal barrier members 86, 76, and 48 of the previous examples except that the attachment section 98 and support 32*d* have different shapes. In the disclosed example, the attachment section 98 includes a slot 100 that extends between the radially outer side 62 and the radially inner side 60. The slot 100 may be formed in any suitable manner as discussed above and with any desired orientation relative to the circumferential sides 58, leading edge 54, and trailing edge 56. In this example, the slot 100 tapers, or narrows, from the radially inner side 60 to the radially outer side 62 to form a frustoconical cavity.

The support 32*d* in this example is a bolt 102 having a head 104 connected with a threaded shank 106. The bolt extends through the slot 100 such that the head 104 is received within the frustoconical cavity and is flush with or recessed below the radially inner side 60. The bolt 102 may be secured to the outer case 32 to secure the thermal barrier member 96 within the gas turbine engine 10.

A cooling passage 108 extends through the threaded shank 106 into the head 104. The cooling passage 108 divides into a plurality of second cooling passages 110 that open out to the radially inner side 60. The cooling passages 108 and 110 receive cooling air from the cooling source 66 to maintain the radially inner side 60 at a desired temperature.

The supports 32*a*, 32*b*, 32*c*, and 32*d* in any of the above examples may be formed from any suitable material. For example, the supports 32*a*, 32*b*, 32*c*, and 32*d* comprise a metal or metal alloy, such as a nickel-based alloy, a cobalt-based alloy, a molybdenum-based alloy, or a niobium-based alloy. In some examples, the supports 32*a*, 32*b*, 32*c*, and 32*d* are solid. However, in other examples, the supports 32*a*, 32*b*, 32*c*, and 32*d* include an open cell foam structure as discussed above, which permits cooling air from the cooling sources 66 to flow there through to cool the supports 32*a*, 32*b*, 32*c*, and 32*d* and respective thermal barrier members 46, 76, 86, and 96.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A thermal barrier comprising:

a porous thermal barrier member including at least one material selected from a metal foam or a ceramic foam, the thermal barrier member having an attachment section for securing the thermal barrier member with a corresponding attachment section of a support, wherein the thermal barrier member is removably attachable to the support, and wherein the attachment section comprises a slot, and the thermal barrier member comprises a body extending between two circumferential sides, a leading edge, a trailing edge, a radially inner side, and a radially outer side relative to a gas turbine engine centerline, and the slot tapers between the radially inner side and the radially outer side.

2. The thermal barrier as recited in claim 1, wherein the slot comprises a T-shaped cross-section.

3. The thermal barrier as recited in claim 1, wherein the slot comprises a curved wall.

4. The thermal barrier as recited in claim 1, wherein the thermal barrier member comprises a body extending between two circumferential sides, a leading edge, a trailing edge, a radially inner side, and a radially outer side relative to a gas turbine engine centerline, where the slot extends through the radially outer side.

5. The thermal barrier as recited in claim 1, wherein the thermal barrier member comprises a body extending between two circumferential sides, a leading edge, a trailing edge, a radially inner side, and a radially outer side relative to a gas turbine engine centerline, where the slot extends through at least one of the two circumferential sides or at least one of the leading edge or the trailing edge.

6. The thermal barrier as recited in claim 1, wherein the thermal barrier member comprises a porous ceramic tile that is removably attachable with the support.

7. The thermal barrier as recited in claim 1, wherein the thermal barrier member includes the ceramic foam, and the ceramic foam includes a ceramic material selected from at least one of zirconia, yttria-stabilized zirconia, silicon carbide, alumina, titania, or mullite.

8. The thermal barrier as recited in claim 1, wherein the thermal barrier member includes the metal foam, and the metal foam includes at least one metal material selected from a nickel-based alloy, a cobalt-based alloy, a molybdenum-based alloy, or a niobium-based alloy.

9. The thermal barrier as recited in claim 1, further comprising the support, the support comprising at least one metal material selected from a nickel-based alloy, a cobalt-based alloy, a molybdenum-based alloy, or a niobium-based alloy.

10. The thermal barrier as recited in claim 1, further comprising the support, and the support comprises a metal foam.

11. The thermal barrier as recited in claim 1, further including a cooling source for providing a coolant to the thermal barrier member.

12. A thermal barrier comprising:

a thermal barrier member including at least one material selected from a metal foam or a ceramic foam, the thermal barrier member having an attachment section for securing the thermal barrier member with a corresponding attachment section of a support, wherein the thermal barrier member is removably attachable to the support, further including a bolt connected with the attachment section, the bolt having a first cooling passage that divides into a plurality of second cooling passages, wherein the bolt is secured to a case surrounding a turbine section.

13. The thermal barrier as recite in claim 12, wherein the bolt is secured to the case by a threaded shank.

14. The thermal barrier as recite in claim 12, wherein the thermal barrier member comprises a body extending between two circumferential sides, a leading edge, a trailing edge, a radially inner side, and a radially outer side relative to a gas turbine engine centerline, wherein the plurality of second cooling passages are at least partially in a head of the bolt, wherein the head sits recessed below a radially inner side.

15. A turbine engine comprising:

a combustion section;

a turbine section downstream of the combustion section and including a turbine blade rotatable about an axis; and at least one blade outer air seal member radially outwards of the turbine blade, the at least one blade outer air seal member comprising a thermal barrier member that includes at least one material selected from a metal foam or a ceramic foam, the thermal barrier member having an attachment section for securing the thermal barrier member with a corresponding attachment section of a support, wherein the attachment section comprises a slot and the thermal barrier member comprises a body extending between two circumferential sides, a leading edge, a trailing edge, a radially inner side, and a radially outer side relative to a gas turbine engine centerline, where the slot extends through at least one of the two circumferential sides or at least one of the leading edge or the trailing edge, wherein the attachment section includes a first cooling passage with an opening at the radially outer side, wherein the first cooling passage divides into a plurality of cooling passages within the attachment section that each extend at least partially through the slot and open to the radially inner side.

16. The turbine engine of claim 15, wherein the plurality of cooling passages includes three cooling passages each diverting air flow in a different direction relative to one another.

17. The turbine engine of claim 15, wherein the thermal barrier member further includes a ceramic foam, the ceramic foam includes a ceramic material selected from at least one of zirconia, yttria-stabilized zirconia, silicon carbide, alumina, titania, or mullite.

18. A thermal barrier comprising: a thermal barrier member including at least one material selected from a metal foam or a ceramic foam, the thermal barrier member having an attachment section for securing the thermal barrier member with a corresponding attachment section of a support, wherein the thermal barrier member is removably attachable to the support, wherein the attachment section comprises a slot, wherein the slot comprises a curved wall for receiving a spherical section of the support.

* * * * *